United States Patent [19]

Horodysky et al.

[11] Patent Number: 4,486,323

[45] Date of Patent: Dec. 4, 1984

[54] LUBRICANTS CONTAINING BORATED MIXTURES OF ALCOHOLS AND SULFIDES

[75] Inventors: Andrew G. Horodysky, Cherry Hill; Joan M. Kaminski, Mullica Hill, both of N.J.

[73] Assignee: Mobil Oil Corporation, New York, N.Y.

[21] Appl. No.: 456,917

[22] Filed: Jan. 10, 1983

[51] Int. Cl.[3] ..... C10M 1/54

[52] U.S. Cl. ..... 252/48.4; 252/48.2; 252/46.3; 252/49.6

[58] Field of Search ..... 252/46.3, 49.6, 48.4, 252/48.2

[56] References Cited

U.S. PATENT DOCUMENTS

| | | | |
|---|---|---|---|
| 2,795,548 | 6/1957 | Thomas et al. | 252/49.6 |
| 4,384,967 | 5/1983 | Satentine et al. | 252/49.6 |
| 4,394,277 | 7/1983 | Small Jr. | 252/49.6 |

*Primary Examiner*—Jacqueline V. Howard

*Attorney, Agent, or Firm*—Alexander J. McKillip; Michael G. Gilman; Claude E. Setliff

[57] ABSTRACT

Lubricant and liquid fuel compositions contain a friction reducing or antioxidant additive. The additive is a borated mixture of (1) a long chain alcohol or an alkoxylated member thereof and (2) a hydroxyalkyl sulfide.

23 Claims, No Drawings

LUBRICANTS CONTAINING BORATED MIXTURES OF ALCOHOLS AND SULFIDES

BACKGROUND OF THE INVENTION

1. Field of the Invention

The invention relates to lubricant and liquid fuel compositions. In particular, it relates to the use of a borated mixture of long chain alcohols and hydroxyalkyl sulfides in liquid fuels and lubricants to reduce friction and fuel consumption in internal combustion engines.

2. Discussion of the Related Art

It is known that sliding or rubbing metal or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present herein.

Friction is also a problem any time two surfaces are in sliding or rubbing contact. It is of special significance in an internal combustion engine and related power train components, because loss of a substantial amount of the theoretical mileage possible from a gallon of fuel is traceable directly to friction.

With respect to the novel compounds of this invention, no art is known that teaches or suggests them, or their use in lubricants or fuels. There are, however, patents that disclose certain sulfur-containing materials, certain alcohols and derivatives thereof. For example, U.S. Pat. No. 3,361,723 discloses a thiol-containing polyether and a process for its preparation and U.S. Pat. No. 4,244,827 teaches mixtures of di- or tri-thiophosphate acid diesters produced from 1,2-diols or 1-mercapto-2-hydroxy compounds and $P_2S_5$.

Alcohols themselves are well known for their lubricity properties when formulated into lubricating oils and for their water-scavenging characteristics when blended into fuels. The use of vicinal hydroxyl-containing alkyl carboxylates such as glycerol monooleate have also found widespread use as lubricity additives. U.S. Pat. No. 2,788,326 discloses some of the esters suitable for the present invention, e.g., glycerol monooleate, as minor components of lubricating oil compositions. U.S. Pat. No. 3,235,498 discloses, among others, the same ester as just mentioned, as an additive to other oils. U.S. Pat. No. 2,443,578 teaches esters wherein the free hydroxyl is found in the acid portion, as for example in tartaric acid.

SUMMARY OF THE INVENTION

In accordance with the invention there is provided a lubricant or liquid fuel composition comprising a major amount of a lubricant or fuel and a friction reducing or antioxidant amount of a borated mixture of compounds of the formulas $$\underset{\underset{OH}{|}}{RSCH}(R^1)_x\underset{\underset{OH}{|}}{CH_2} \quad \text{and} \quad R^2(OR^3)_yOH$$

where R is a $C_8$ to $C_{22}$ hydrocarbyl group, $R^1$ is an alkyl group containing 1 or 2 carbon atoms, $R^2$ is an aliphatic group containing from 8 to 22 carbon atoms or mixtures thereof, $R^3$ is an alkylene group containing 2 to 5 carbon atoms, x is 0 or 1, and y is 0 to 4. R can comprise branched or straight chains, saturated or unsaturated groups, and includes alkenyl, alkyl, aryl, alkaryl, aralkyl, cycloalkyl and the like. $R^2$ includes alkyl as the preferred member, but also includes others such as alkenyl and the like.

It will be understood that the mixture of, for example, alcohols can be obtained by mixing the respective alcohols per se or by arranging the alcohol manufacturing process to obtain the mixed alcohol as the product.

DESCRIPTION OF SPECIFIC EMBODIMENTS

The hydroxylalkyl sulfides can be made by several processes known to the art. For example, they can be made by reacting a sodium alkylmercaptide with a diol, in accordance with the equation $$RSNa + \underset{\underset{Cl}{|}}{CH_2}\underset{\underset{OH}{|}}{CH}\underset{\underset{OH}{|}}{CH_2} \longrightarrow RSCH_2\underset{\underset{OH}{|}}{CH}\underset{\underset{OH}{|}}{CH_2}$$

The same or similar compounds can be prepared from the reaction $$HSCH_2\underset{\underset{OH}{|}}{CH}\underset{\underset{OH}{|}}{CH_2} + RBr + NaOH \xrightarrow[\text{PTC}]{\text{H}_2\text{O, Toluene}} RSCH_2\underset{\underset{OH}{|}}{CH}\underset{\underset{OH}{|}}{CH_2}$$

in which PTC is a phase transfer catalyst, e.g. $(C_8\text{–}C_{10})_3\text{—}N^+CH_3Cl\text{–}$, used to enhance the solubility of the mercaptide formed in situ. Some of the useful hydroxyalkyl sulfides that may be mentioned are 1,2-dihydroxypropane octadecyl sulfide, 1,2-dihydroxypropane isostearyl sulfide, 1,2-dihydroxypropane octyl sulfide, 1,2-dihydroxypropane decyl sulfide, 1,2-dihydroxypropane dodecyl sulfide, and the like. It should be understood that these are not limiting, but are offered only to assist one of skill in this art in determining the useful sulfides.

In both the reactions shown, equimolar amounts of reactants are used. The first reaction set forth is run at from about 60° C. to about 100° C., preferably at from about 70° C. to about 80° C. for from about 2 to about 8, preferably for from about 3 to about 5 hours. A solvent is preferred for this reaction, usually alcohols. These include ethanol, isopropanol and butanol, preferably isopropanol.

The second reaction is best run at from ambient room temperature to about 50° C., with room temperature to about 40° C. being preferred. It is run for from 30 minutes to 2 hours in water and hydrocarbon solvents such as benzene or toluene, and in the presence of a phase transfer agent. Preferred agents are quaternary nitrogen and phosphorus halides. An example is the preferred methyltri ($C_8$–$C_{10}$) alkylammonium chloride.

The long chain alcohols (i.e., when y in the formula of the Summary is zero) or mixtures thereof that may be used for the purposes disclosed herein have the formula $$R^2OH$$

include such alcohols, or mixtures of such alcohols, as oleyl alcohol, $C_{12}$–$C_{15}$ alkanols. The ethoxylated alcohols include ethoxylated and propylated oleyl alcohol, mixed $C_{12}$ to $C_{15}$ alkanol, dodecanol and the like.

In borating the mixture, we prefer to mix the alcohol and hydroxy sulfide and to react the mixture with the boron compound. The preferred reaction mixture contains equimolar amounts of each component, i.e., the sulfide, alcohol and boron compound preferably are present in a 1:1:1 molar ratio. It is contemplated, however, that the sulfide can be present in an amount of from 5% to 95% by weight of the alcohol, with a complementary amount of the alcohol.

Reaction with boric oxide or any other appropriate boron compound, including one or more of the formula:

$$(R^4O)_aB(OH)_b$$

where $R^4$ is a $C_1$ to $C_6$ alkyl, a is 0 to 3 and b is 0 to 3, the sum of a and b being 3, can be performed in the presence of an alcoholic solvent, such as propanol, butanol or pentanol and the like, or a hydrocarbon solvent such as benzene, toluene or xylene, or mixtures of such solvents. Reaction temperatures of 90° C. to 260° C. or more can be used, but 110° C. to 200° C. is preferred. Reaction times can be 1 to 24 hours and more. As mentioned above, up to a stoichiometric amount of boric acid can be used, or an excess thereof can be used to produce a derivative containing from about 0.1% to about 10% of boron. At least 5% to 10%, and preferably 75 to 100%, of the available hydroxyl groups should be borated to derive substantial beneficial effect. Conversely, a stoichiometric excess of boric acid (more than an equivalent amount of boronating agent compared to available hydroxyl groups) can also be charged to the reaction medium, resulting in a product containing the stated amount of boron. The compounds can also be borated with a trialkyl borate such as tributyl borate, often in the presence of boric acid. Preferred reaction temperatures for boration with the borate will range from about 180° C. to about 280° C. Times can be from about 2 to about 12 hours, or more, whether the mixture is borated or each is borated and then mixed.

The hydroxyalkyl sulfides are used with lubricating oils to the extent of from about 0.1% to about 10% by weight of the total composition. Furthermore, other additives, such as detergents, antioxidants, anti-wear agents and the like may be present. These can include phenates, sulfonates, succinimides, zinc dithiophosphates, polymers, calcium and magnesium salts and the like.

The lubricants contemplated for use with the esters herein disclosed include mineral and synthetic hydrocarbon oils of lubricating viscosity, mixtures of mineral oils and synthetic oils and greases from any of these, including mixtures. The synthetic hydrocarbon oils include long-chain alkanes such as cetanes and olefin polymers such as oligomers of hexane, octene, decene, and dodecene, etc. The compounds of the invention are especially effective in synthetic oils formulated using mixtures of synthetic hydrocarbon olefin oligomers and lesser amounts of hydrocarbyl carboxylate ester fluids. The other synthetic oils, which can be used alone with the compounds of this invention, or which can be mixed with a mineral or synthetic hydrocarbon oil, include (1) fully esterified ester oils, with no free hydroxyls, such as pentaerythritol esters of monocarboxylic acids having 2 to 20 carbon atoms trimethylolpropane esters of monocarboxylic acids having 2 to 20 carbon atoms, (2) polyacetals, and (3) siloxane fluids. Especially useful among the synthetic esters are those made from polycarboxylic acids and monohydric alcohols. More preferred are the ester fluids made by fully esterifying pentaerythritol, or mixtures thereof with di- and tripentaerythritol, with an aliphatic monocarboxylic acid containing from 1 to 20 carbon atoms, or mixtures of such acids.

A wide variety of thickening agents can be used in the greases of this invention. Included among the thickening agents are alkali and alkaline earth metal soaps of fatty acids and fatty materials having from about 12 to about 30 carbon atoms per molecule. The metals are typified by sodium, lithium, calcium and barium. Fatty materials are illustrated by stearic acid, hydroxystearic acid, stearin, cottonseed oil acids, oleic acid, palmitic acid, myristic acid and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylateacetate complexes (U.S. Pat. No. 2,999,065), calcium-caprylateacetate (U.S. Pat. No. 2,999,066), and calcium salts and soaps of low-, intermediate- and high-molecular weight acids and of nut oil acids.

Another group of thickening agents comprises substituted ureas, phthalocyanines, indanthrene, pigments such as perylimides, pyromellitdiimides, and ammeline.

The preferred thickening gelling agents employed in the grease compositions are essentially hydrophobic clays. Such thickening agents can be prepared from clays which are initially hydrophilic in character, but which have been converted into a hydrophobic condition by the introduction of long chain hydrocarbon radicals into the surface of the clay particles; prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention. More specifically, the clays which are useful as starting materials in forming the thickening agents to be employed in the grease compositions, can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays, and the like. The thickening agent is employed in an amount from about 0.5 to about 30, and preferably from 3 percent to 15, percent by weight of the total grease composition.

The liquid fuels contemplated include liquid hydrocarbon fuels such as fuel oils, diesel oils and gasolines and alcohol fuels such as methanol, propanol, ethanol and mixtures of such alcohols as well as such alcohols mixed with the hydrocarbon fuels. These fuels can include from 2 pounds per 1000 bbl of fuel to 500 pounds per 1000 bbl of fuel of the compound described hereinabove. Preferably from about 5 to about 35 pounds of compound per 1000 bbl of fuel are used.

Having described the invention in general terms, the following are offered to specifically illustrate the development. It is to be understood they are illustrations only and that the invention shall not be limited except as limited by the appended claims.

In Examples 2, 4 and 5, the "$C_{12}$–$C_{15}$" linear alcohols are mixtures of $C_{12}$, $C_{13}$, $C_{14}$ and $C_{15}$ alcohols with the composition as set forth in Example 2.

EXAMPLE 1

Synthesis of 1,2-dihydroxypropane octadecyl sulfide

A mixture of 90% 1-mercaptoglycerol (56.7 g), 1-bromooctadecane (156.5 g), 50% sodium hydroxide (37.6 g), methyl tri ($c_8$–$C_{10}$) alkyl ammonium chloride (11.2 g), 40 cc toluene, and 20 cc of water was stirred vigorously. After an initial exotherm of 74° C. the reaction temperature slowly decreased and the reaction was continued at ambient temperature for 2 hours. Approximately 300 cc of toluene and 100 cc of water were added, and the reaction was heated to reflux. The hot reaction mixture was transferred to a separatory funnel, and the water layer was removed. The toluene solution was washed twice, each time with 100 cc of water and dried over magnesium sulfate. The acidified water washes contained no 1-mercaptoglycerol.

The toluene solution was filtered through diatomaceous earth. Solvent was removed by high speed rotary evaporation yielding a white, solid product.

EXAMPLE 2

Synthesis of borated mixed $C_{12}$–$C_{15}$ linear alcohols and 1,2-dihydroxypropane octadecyl sulfide A mixture of (1) $C_{12}$–$C_{15}$ linear alcohols [(28.9 g) containing 12% $C_{12}$,30% $C_{13}$, 14% $C_{14}$ and 24% $C_{15}$], and (2) 1,2-dihydroxypropane octadecyl sulfide (50 g), the latter prepared as described in Example 1, was dissolved in 20 g of n-butanol and 60 g of toluene solvents at 80° C. Boric acid (8.6 g) was added, and the reaction temperature was increased. The expected amount of water was removed between 90° C. and 112° C. via azeotropic distillation. The reaction solution was cooled to room temperature and filtered through diatomaceous earth. Solvents were removed by high speed rotary evaporation yielding a white, waxy solid product.

EXAMPLE 3

Synthesis of 1,2-dihydroxypropane dodecyl sulfide

Approximately 397 g of 50% aqueous sodium hydroxide solution was added dropwise over a period of 7 hours to a solution of n-dodecyl mercaptan (1000g) and 1-chloropropane-2,3-diol (547g) in isopropanol solvent (2000 cc) at ambient temperature. The reaction temperature rose from 21° to 56° C. during the addition. The reaction was refluxed for 5 hours at 80° C. and then filtered hot through paper to remove the precipitated salt. The isopropanol solvent was removed by distillation. The product residue was dissolved in about 4000 cc of toluene and washed with water several times. The toluene solution was dried over magnesium sulfate and filtered through diatomaceous earth. Toluene was removed by high speed rotary evaporation to yield a white solid product.

EXAMPLE 4

Synthesis of borated mixed $C_{12}$–$C_{15}$ linear alcohols and 1,2-dihydroxypropane dodecyl sulfide A mixture of $C_{12}$–$C_{15}$ linear alcohols (45.1 g) and 1,2-dihydroxypropane dodecyl sulfide (60 g), the latter prepared as described in Example 3, was dissolved in 20 g n-butanol and 60 g toluene solvents at 60° C. Boric acid (13.4 g) was added, and the reaction temperature was increased. The expected amount of water was removed between 95° C. and 120° C. via azeotropic distillation. The reaction solution was cooled to room temperature and filtered through diatomaceous earth. Solvents were removed by high speed rotary evaporation yielding a clear, colorless, liquid product.

EXAMPLE 5

Synthesis of borated mixed $C_{12}$–$C_{15}$ linear triethoxylated alcohols and 1,2-dihydroxypropane dodecyl sulfide A mixture of $C_{12}$–$C_{15}$ linear triethoxylated alcohols (48.6 g) and 1,2-dihydroxypropane dodecyl sulfide (40 g), the latter prepared as described in Example 3, was dissolved in 20 g n-butanol and 60 g toluene solvents at 60° C. Boric acid (8.94 g) was added, and the reaction temperature was increased. The expected amount of water was removed between 95° C. and 120° C. via azeotropic distillation. The reaction solution was cooled to room temperature and filtered through diatomaceous earth. Solvents were removed by high speed rotary evaporation yielding a clear, colorless, liquid product.

EVALUATION OF PRODUCTS

The compounds were evaluated as friction modifiers in accordance with the following test.

Low Velocity Friction Apparatus

Description

The Low Velocity Friction Apparatus (LVFA) is used to measure the friction of test lubricants under various loads, temperatures, and sliding speeds. The LVFA consists of a flat SAE 1020 steel surface (diameter 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam motor arrangement.

Procedure

The rubbing surfaces and 12-13 ml of test lubricant are placed on the LVFA. A 240 psi load is applied, and the sliding speed is maintained at 40 fpm at ambient temperature for a few minutes. A plot of coefficients of friction ($U_k$) over the range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 240 psi and 40 fpm sliding speed. Afterward, measurements of $U_k$ vs. speed are taken at 240, 300, 400, and 500 psi. Freshly polished steel specimens are used for each run. The surface of the steel is parallel ground to 4–8 microinches.

The data obtained are shown in Table 1. The data in Table 1 are reported as percent reduction in coefficient of friction at two speeds. The fully formulated base 5W-20 synthetic lubricating oil had the following general characteristics:

Viscosity 100° C. — 6.8 cs
Viscosity 40° C. — 36.9 cs
Viscosity Index — 143

TABLE 1

| Additive and Medium | Frictional Characteristics: Additive Conc. Wt. % | Reduction or % Change in Coefficient of Friction: 5 Ft./Min | 30 Ft./Min. |
|---|---|---|---|
| Base Oil | — | 0 | 0 |
| Example 2 | 1.0 | 49 | 43 |
| | 0.5 | 45 | 43 |
| Example 4 | 1.0 | 42 | 38 |
| Example 5 | 1.0 | 44 | 36 |

We claim:

1. A product of reaction made by reacting, at from about 90° C. to about 260° C., (1) a mixture of compounds of the formulas $$\underset{\underset{OH}{|}}{RSCH}(R_1)_x\underset{\underset{OH}{|}}{CH_2} \quad \text{and} \quad R_2(OH^3)_yOH$$

wherein R is a $C_8$ to $C_{22}$ hydrocarbyl group, $R_1$ is an alkyl group having 1 to 2 carbon atoms, $R^2$ is an aliphatic group containing from 8 to 22 carbon atoms or mixtures thereof, $R^3$ is an alkylene group constaining 2 to 5 carbon atoms, x is 0 or 1 and y is 0 to 4, said mixture containing from about 5% to about 95% by weight of the sulfide and a complementary amount of the alcohol, with (2) an amount of a boron compound sufficient to borate at least about 5% of the hydroxyl groups present in said mixture.

2. The product of claim 1 wherein R is an alkyl, alkenyl, aryl, alkaryl, aralkyl or cycloalkyl group.

3. The product of claim 1 wherein $R^2$ is an alkyl or alkenyl group.

4. The product of claim 1 wherein the boron compound is boric oxide or is of the formula $$(R^4O)_aB(OH)_b$$

wherein $R^4$ is a $C_1$ to $C_6$ alkyl group, a is 0 to 3 and b is 0 to 3, their sum being 3.

5. The product of claim 4 wherein the boron compound is boric acid.

6. The product of claim 1 wherein the mixture is of 1,2-dihydroxypropane octadecyl sulfide and a mixed $C_{12}$ to $C_{15}$ alcohol and the boron compound is boric acid.

7. The product of claim 1 wherein the mixture is of 1,2-dihydroxypropane dodecyl sulfide and a mixed $C_{12}$ to $C_{15}$ alcohol and the boron compound is boric acid.

8. The product of claim 1 wherein the mixture is of 1,2-dihydroxypropane dodecyl sulfide and a mixed $C_{12}$ to $C_{15}$ triethoxylated alcohol and the boron compound is boric acid.

9. A lubricant composition comprising a major proportion of a lubricating oil or grease therefrom and an antifriction amount of a product of reaction made by reacting, at from about 90° C. to about 260° C., (1) a mixture of compounds of the formula $$\underset{\underset{OH}{|}}{RSCH}(R_1)_x\underset{\underset{OH}{|}}{CH_2} \quad \text{and} \quad R_2(OH^3)_yOH$$

wherein R is a $C_8$ to $C_{22}$ hydrocarbyl group, $R_1$ is an alkyl group having 1 to 2 carbon atoms, $R^2$ is an aliphatic group containing from 8 to 22 carbon atoms or mixtures thereof, $R^3$ is an alkylene group constaining 2 to 5 carbon atoms, x is 0 or 1 and y is 0 to 4, said mixture containing from about 5% to about 95% by weight of the sulfide and a complementary amount of the alcohol, with (2) an amount of a boron compound sufficient to borate at least about 5% of the hydroxyl groups present in said mixture.

10. The composition of claim 9 wherein in the product R is an alkyl, alkenyl, aryl, alkaryl, aralkyl or cycloalkyl group.

11. The composition of claim 9 wherein in the product $R^2$ is an alkyl or alkenyl group.

12. The composition of claim 9 wherein in the product the boron compound is boric oxide or is of the formula $$(R^4O)_aB(OH)_b$$

wherein $R^4$ is a $C_1$ to $C_6$ alkyl group, a is 0 to 3 and b is 0 to 3, their sum being 3.

13. The composition of claim 12 wherein in the product the boron compound is boric acid.

14. The composition of claim 9 wherein in the product the mixture is of 1,2-dihydroxypropane octadecyl sulfide and a mixed $C_{12}$ to $C_{15}$ alcohol and the boron compound is boric acid.

15. The composition of claim 9 wherein in the product the mixture is of 1,2-dihydroxypropane dodecyl sulfide and mixed $C_{12}$ to $C_{15}$ alcohol and the boron compound is boric acid.

16. The composition of claim 9 wherein in the product the mixture is of 1,2-dihydroxypropane dodecyl sulfide and a mixed $C_{12}$ to $C_{15}$ triethoxylated alcohol and the boron compound is boric acid.

17. The composition of claim 9 wherein the lubricant is (1) a mineral oil, (2) a synthetic oil, (3) mixtures of mineral and synthetic oils or of two or more synthetic oils and (4) greases from (1), (2) or (3).

18. The composition of claim 17 wherein the lubricant is a mineral oil.

19. The composition of claim 17 wherein the lubricant is a grease.

20. The composition of claim 17 wherein the lubricant is a synthetic oil or mixture of synthetic oils.

21. The product of claim 1 wherein the boron content in said product of reaction is from about 0.1% to about 10%.

22. The composition of claim 9 wherein the boron content in said product of reaction is from about 0.1% to about 10%.

23. A method of reducing fuel consumption in an internal combustion engine which comprises lubricating said engine with a lubricating oil composition comprising a major proportion of a lubricating oil and an anti-friction amount of a product of reaction made by reacting, at from about 90° C. to about 260° C., (1) a mixture of compounds of the formula $$\underset{\underset{OH}{|}}{RSCH}(R_1)_x\underset{\underset{OH}{|}}{CH_2} \quad \text{and} \quad R_2(OH^3)_yOH$$

wherein R is a $C_8$ to $C_{22}$ hydrocarbyl group, $R_1$ is an alkyl group having 1 to 2 carbon atoms, $R^2$ is an aliphatic group containing from 8 to 22 carbon atoms or mixtures thereof, $R^3$ is an alkylene group constaining 2 to 5 carbon atoms, x is 0 or 1 and y is 0 to 4, said mixture containing from about 5% to about 95% by weight of the sulfide and a complementary amount of the alcohol, with (2) an amount of a boron compound sufficient to borate at least about 5% of the hydroxyl groups present in said mixture.

* * * * *

UNITED STATES PATENT AND TRADEMARK OFFICE

CERTIFICATE OF CORRECTION

PATENT NO. : 4,486,323

DATED : December 4, 1984

INVENTOR(S) : Andrew J. HORODYSKY et al

It is certified that error appears in the above-identified patent and that said Letters Patent is hereby corrected as shown below:

In claims 1, 9, and 23, please rewrite the structural formulas thus:

-- $RS\underset{\underset{OH}{|}}{CH}(R^1)_x\underset{\underset{OH}{|}}{CH_2}$ and $R^2(OR^3)_yOH$ --

In Column 7, line 39; Column 8, lines 11 and 15, and Column 10, lines 1 and 6, change "$R_1$" to --$R^1$--.

Signed and Sealed this

*Eleventh* Day of *June 1985*

[SEAL]

*Attest:*

DONALD J. QUIGG

*Attesting Officer* *Acting Commissioner of Patents and Trademarks*